US006838632B1

(12) United States Patent
Via et al.

(10) Patent No.: US 6,838,632 B1
(45) Date of Patent: Jan. 4, 2005

(54) SWITCH CONTACT DEVICE FOR INTERRUPTING HIGH CURRENT, HIGH VOLTAGE, AC AND DC CIRCUITS

(75) Inventors: Lester C. Via, Springfield, VA (US); F. Douglas Witherspoon, Fairfax Station, VA (US); John M. Ryan, Fairfax, VA (US)

(73) Assignee: Utron Inc., Manassas, VA (US)

( * ) Notice: Subject to any disclaimer, the term of this patent is extended or adjusted under 35 U.S.C. 154(b) by 0 days.

(21) Appl. No.: 10/420,717

(22) Filed: Apr. 23, 2003

Related U.S. Application Data

(60) Provisional application No. 60/374,495, filed on Apr. 23, 2002.

(51) Int. Cl.[7] ..... H01H 9/30

(52) U.S. Cl. ..... 218/147; 218/146; 200/252

(58) Field of Search ..... 218/123, 146, 218/147, 158; 200/263, 262, 250–253, 571, 259, 550, 549, 541, 563

(56) References Cited

U.S. PATENT DOCUMENTS 3,239,637 A * 3/1966 Pierce ..... 200/531
4,426,562 A * 1/1984 Kemeny ..... 218/117
5,818,148 A * 10/1998 Shiomi ..... 200/259
5,898,142 A * 4/1999 Ohtaki et al. ..... 200/16 C

* cited by examiner

*Primary Examiner*—Lincoln Donovan
*Assistant Examiner*—M. Fishman
(74) *Attorney, Agent, or Firm*—James Creighton Wray; Meera P. Narasimhan

(57) ABSTRACT

A high voltage switch contact structure capable of interrupting high voltage, high current AC and DC circuits. The contact structure confines the arc created when contacts open to the thin area between two insulating surfaces in intimate contact. This forces the arc into the shape of a thin sheet which loses heat energy far more rapidly than an arc column having a circular cross-section. These high heat losses require a dramatic increase in the voltage required to maintain the arc, thus extinguishing it when the required voltage exceeds the available voltage. The arc extinguishing process with this invention is not dependent on the occurrence of a current zero crossing and, consequently, is capable of rapidly interrupting both AC and DC circuits. The contact structure achieves its high performance without the use of sulfur hexafluoride.

22 Claims, 3 Drawing Sheets

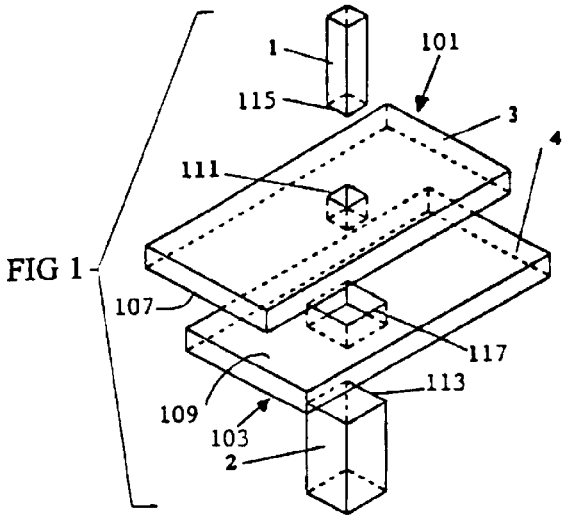
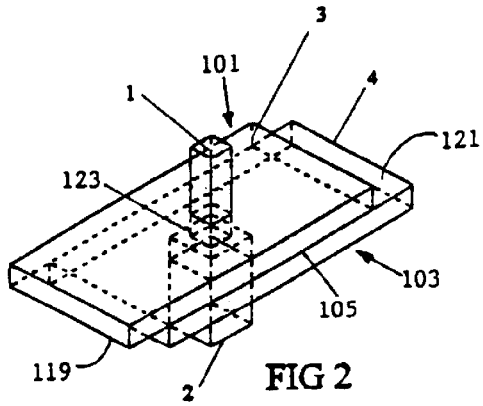
FIG 2
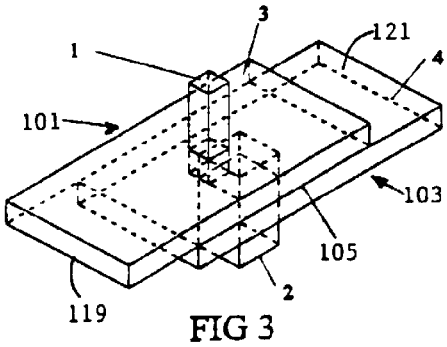
FIG 3
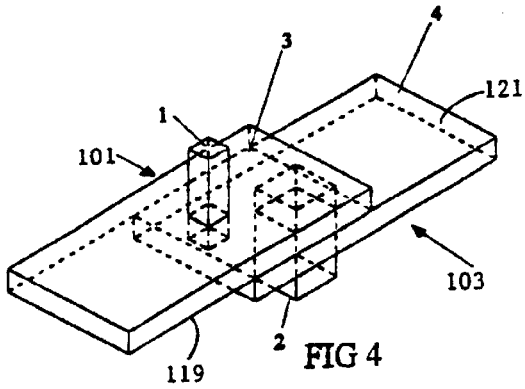
FIG 4
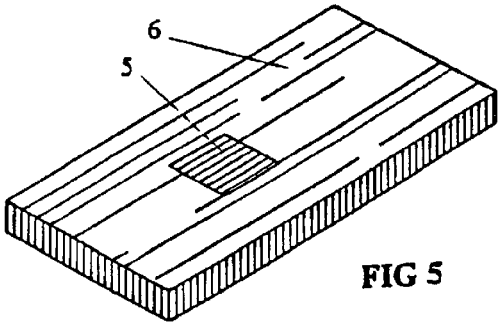
FIG 5

SWITCH CONTACT DEVICE FOR INTERRUPTING HIGH CURRENT, HIGH VOLTAGE, AC AND DC CIRCUITS

This application claims the benefit of U.S. Provisional Application No. 60/374,495 filed Apr. 23, 2002. +gi This invention was made with Government support under Contract No. DE FG02-99ER52915 awarded by the Department of Energy. The Government has certain rights in this invention.

BACKGROUND OF THE INVENTION

The present invention relates to contact structures of high voltage circuit breakers. More specifically, contact structures using an interposed solid nonconductor to extinguish the arc.

The interruption of DC high voltage, high current circuits is particularly difficult due to the lack of periodically occurring current zero crossings. Arcs exhibit a negative resistance characteristic in that the arc voltage decreases with increasing current. Consequently, switch contact arcs of more than a few amperes require little voltage to maintain, and, without an arc quenching means, will continue to quickly destroy the switch contacts. The arc is extinguished by using techniques that cause a momentary current zero or techniques that raise the voltage required to maintain the arc above the voltage available or by breaking the arc into a series of short arcs.

Conventional devices use different methods for accomplishing one or more of these basic arc quenching techniques. However, most of the high voltage high current switches now in use require the use of sulfur hexafluoride, a potent greenhouse gas considered nearly 25,000 times more damaging to the environment than carbon dioxide.

Contact structures can be found in Harton et al., U.S. Pat. No. 3,053,945, and Fisher, U.S. Pat. No. 3,026,396. However, neither of those devices is intended to open active high current circuits, only to reliably isolate circuits after an additional breaker has interrupted the main load circuit.

SUMMARY OF THE INVENTION

The present invention uses a novel technique to dramatically increase the voltage required to maintain a contact arc thus significantly raising the maximum voltage interrupting capability of any switch using the contact structure without requiring the use of sulfur hexafluoride. Holding the insulating surfaces in intimate contact significantly increases the voltage interrupting capability. The arc's required maintenance voltage can be increased by lengthening the arc path, increasing the arc's heat losses, and interposing a nonconductor in the arc path.

It is the object of the present invention to provide a simple switch contact structure that is capable of rapidly interrupting high voltage, high current, DC or AC circuits.

The strategy of increasing the rate of heat transfer between the contact arc and its surrounding environment, thus increasing the voltage required to sustain the contact arc, is of particular relevance to this invention. Although the heat transfer is difficult to accurately predict, the increase in arc voltage due to the increase in heat losses is easy to understand. An arc loses heat energy by radiation, conduction, and convection, and any arc in thermal equilibrium absorbs electrical energy at a rate equal to these losses.

At any given current, if measures are taken that increase the arc's losses, there must be a corresponding increase in arc voltage to supply the additional energy or the arc will continually cool and extinguish. Consequently, the key to quenching an arc is to increase its losses until the voltage required to maintain it is greater than the available voltage.

The present invention dramatically increases the voltage required to maintain a switch contact arc by forcing the arc to assume the shape of a very thin sheet. A thin sheet has a high ratio of surface area to cross-sectional area, thus maximizing the arc's heat losses and, consequently, the arc's required maintenance voltage.

These and further and other objects and features of the invention are apparent in the disclosure, which includes the above and ongoing written specification, with the claims and the drawings.

BRIEF DESCRIPTION OF THE DRAWINGS

FIG. 1 is an exploded perspective view of a contact structure using plane surfaces.

FIG. 2 is a perspective view of the contact structure of FIG. 1 in the closed position.

FIG. 3 is a perspective view of the contact structure of FIG. 1 just as the contacts begin to open.

FIG. 4 is a perspective view of the contact structure of FIG. 1 with the contacts completely open.

FIG. 5 is a perspective view of an armature for the contact structure of FIG. 1.

DETAILED DESCRIPTION OF THE INVENTION

Figure 6:
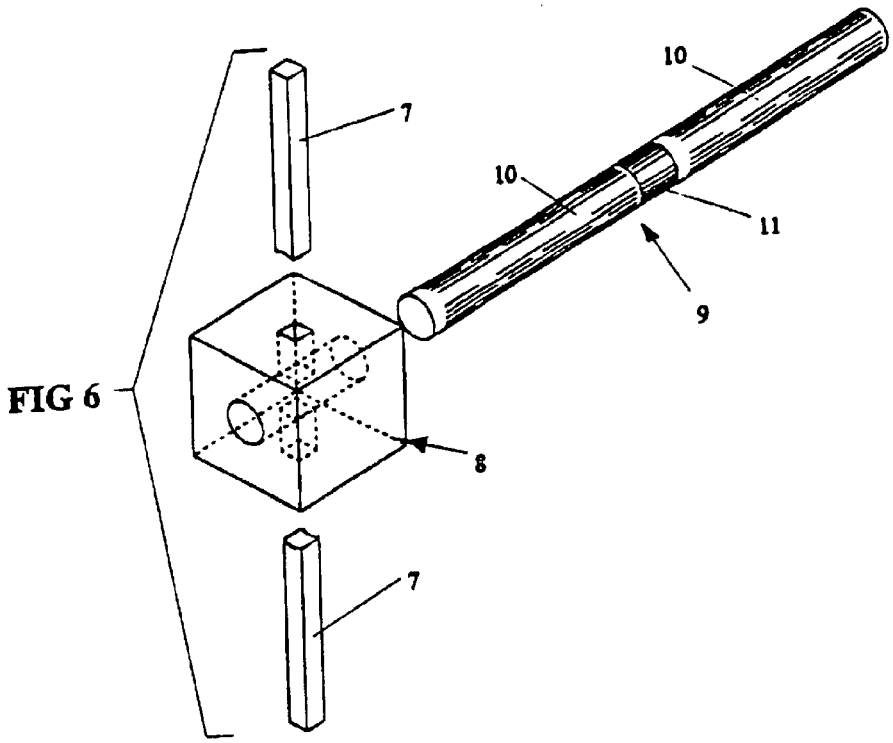
FIG. 6 is a perspective view of the contact structure using cylindrical surfaces.

A basic form of the invention is shown in FIGS. 1–4. A preferred embodiment includes at least a pair of electrodes 1 and 2 in a pair of insulating blocks 3 and 4 forming a pair of sliding surface assemblies 101, 103, preferably in intimate contact 105 with each other. Preferably, blocks 3, 4 and surfaces 107, 109, respectively, have holes 111, 117 which receive electrodes 1, 2. The ends 113, 115 of electrodes 1 and 2 form conductive metallic contacts within the nonconductive insulating areas of the contact-surrounding nonconducting surface areas 119, 121 of insulating blocks 3 and 4. When the metallic contacts 115, 113, are mutually aligned and contacting each other 123 as depicted in FIG. 2, the switch is closed. Conversely, when the metallic contacts are moved out of alignment and are no longer touching each other, the switch is open, as shown in FIG. 4. As these contacts just begin to break connection, as shown in FIG. 3, any arc created is forced to assume the shape of a thin sheet between the two insulating blocks 3 and 4, which are held in intimate contact.

The losses of such an arc are usually extremely high due to the large surface area of a thin sheet relative to its cross-sectional area. Consequently, a much higher voltage is required to maintain this arc compared to one of the same current that is free to assume the normally circular cross-section. At low currents, the arc may form a number of thin filamentary arcs rather than a thin sheet but will still have greater losses than a single arc column conducting the same current.

It is important that both the conductive areas 115, 113 and nonconductive areas 119, 121, of the sliding surfaces 107, 109, are in intimate contact. The insulating surfaces fit together tightly so as to minimize the thickness of the sheet arc, thus maximizing its heat losses. The metallic contact areas are also in intimate contact with each other when closed so as to minimize the contact resistance. This is essential when using the contacts to conduct and interrupt high currents. Springs or interference fits or the like may be used to ensure intimate contact between both insulating and conductive surfaces.

The insulating portions 119, 121 of the sliding surfaces 107, 109 need not totally surround the metallic contact areas, as is shown in FIGS. 1–4. The insulating portions 119, 121 may be limited only to areas near the points where electrical connection is finally broken. The surface contours may be of any form that allows opposing surfaces to slide against each other while remaining in intimate contact over a substantial area. This includes, but is not limited to, plane, triangular, quadrilateral, polygonal, cylindrical, and spherical surfaces, or any surface of revolution.

The addition of a nonconductive armature 6, shown in FIG. 5, between the insulating blocks, 3 and 4, allow these blocks to remain stationary. The contact structure is opened and closed by sliding the armature relative to the blocks 3, 4 shown in FIGS. 1–4. The contact structure is closed when the conductive section 5, which extends through the insulating armature block 6, is in contact with the electrodes 1 and 2 and is open when the conductive section is not in contact with the electrodes.

A cylindrical surface is a particularly useful form of the present invention. FIG. 6 shows a cylindrical insulating rod or armature 9 containing a short conductive segment 11 inserted into a tight fitting hole in a stationary insulating block 8. The conductive segment 11 makes an electrical connection between partially cylindrical contact surfaces of a pair of radially opposing electrodes 7 or resilient contact structures held against the armature. The electrical connection is opened by moving the armature 9 until the electrodes 7 are resting on the armature's insulating segments 10 some distance away from the conductive segment 11. As the connections open, the arcs created assume the form of thin curved sheets on opposite sides of the armature, between its cylindrical surface and the inner surface of the hole in the insulating block. This arrangement breaks two connections, one at each electrode 7 contact point with the armature's conductive segment 11, forming two arcs in series, thus doubling the voltage interrupting capability compared to breaking a single connection.

Figure 7:
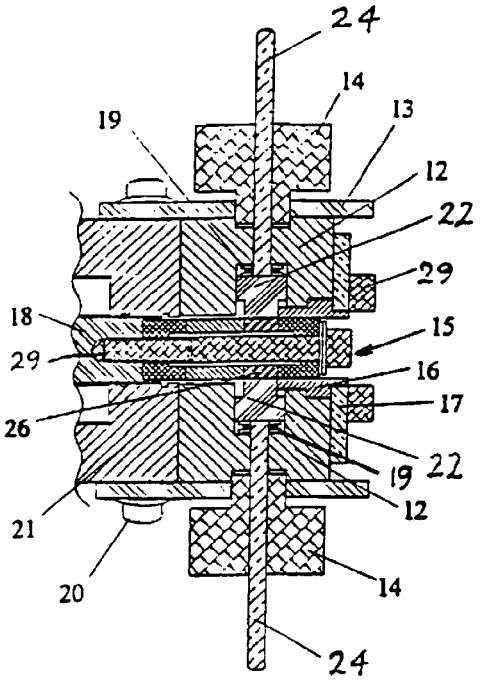
FIG. 7 is a cross-sectional view of a preferred embodiment of the contact structure of FIG. 6.
Figure 8:
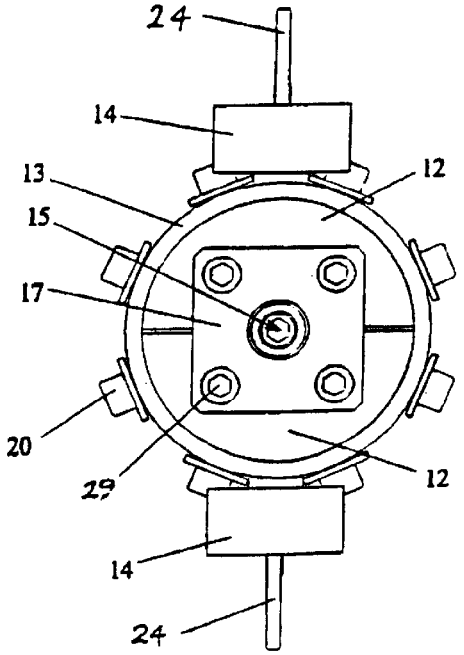
FIG. 8 is an end view of the embodiment of FIG. 7.
Figure 9:
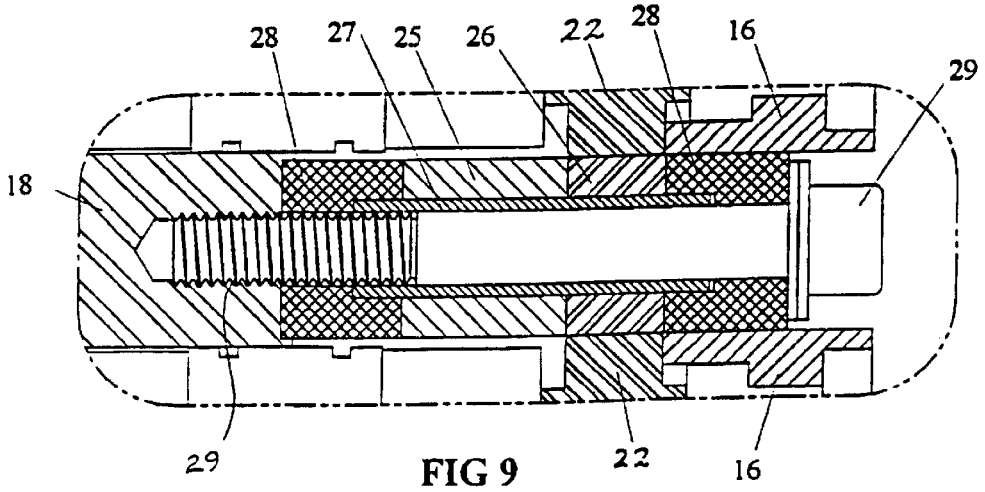
FIG. 9 is a detailed and enlarged view of the armature used in the embodiment of FIG. 7.

FIGS. 7–9 show further details of the contact structure of FIG. 6. The armature details are shown in FIG. 9. A split insulated contact block 12 surrounds the armature 15. The contact ends 22 of the electrodes 24 are electrically connected together by the armature's conductive ring 26 when the contacts are in the closed position as shown in FIG. 7 and FIG. 9. Suitable washers such as, but not limited to, spring washers 19 hold the contacts 22 tightly against the conductive ring 26.

The contact assembly housing 13 holds the split contact blocks 12 together and serves to mount the contact assembly to a switch actuator housing 21 with connectors, for example, screws 20. A pair of insulators 14 hold the electrodes 10 centered as they pass through holes in the housing 13. The armature 15 is attached to the end of the actuating rod 18 using the armature's cap screw or bolt 29.

As shown in FIG. 9, the armature 15 consists of an insulating segment 25, the conducting ring segment 26, both mounted on an insulating tube 27, and tightly sandwiched between a pair of insulating end caps 28 using the bolt 29. The contact assembly is opened by the actuating rod 18, pushing the armature's conducting ring 26 deep into the insulating seal ring 16.

As the insulating ring segment 26 breaks the electrical connection between the electrode contacts 22, any arc created is confined by the inner surface of the seal ring 16 and the armature's insulating ring 25. Either a precise fit or a slight interference fit, depending on the choice of insulating materials, between the insulating ring 25 and the seal ring 16 leaves virtually no space for the arc, forcing it to assume the shape of a thin curved sheet on opposite sides of the insulating ring 25. A slight interference fit works well when a plastic is used for either the insulating ring 25 or the seal ring 16 (or both). A precision fit is needed when both are hard, rigid insulating materials such as, but not limited to, ceramic. The insulating seal ring 16 is held in place by plate 17 and screws 19. The insulating seal ring 16 is thus easily replaced by removing the screws 19 and the plate 17. The armature components are also easily replaced.

Figure 10:
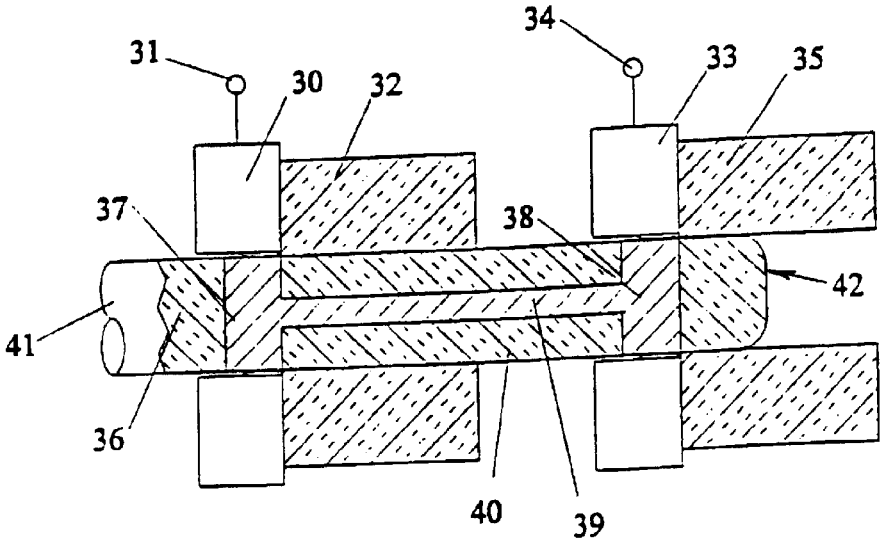
FIG. 10 is a part cross-sectional, part schematic view of a preferred embodiment of a contact structure suitable for high voltages.

Another configuration of the present invention is shown in FIG. 10. A rod armature 42 electrically connects a pair of resilient contact structures 30 and 33. Suitable resilient contact structures may consist of a cylindrical array of highly conductive metallic fingers making electrical contact with the cylindrical surface of another good electrical conductor. A puffer type interrupter showing a typical finger structure is shown, for example, in Meyer et al., U.S. Pat. No. 5,654,532.

The connection is made by a pair of conductive segments 37 and 38 of the armature 42, connected to each other with conductive rod 39 under the surface of an insulating segment 40 placed between the two conductive segments 37 and 38. Tight fitting insulating blocks 32 and 35 are immediately adjacent to the resilient contact structures 30 and 33. Conductors 31 and 34 are connected to the contact structures 30 and 33. The electrical connection between the resilient contact structures 30 and 33 is opened by moving the armature 42 until the resilient contacts 30 and 33 are resting on insulated segments 36 and 40 of the armature. The conductive segments 37 and 38 are some distance into the insulating blocks 32 and 35, confining the arcs between the insulating surfaces as previously described. Precision fits in lieu of tight fit may be used with rigid insulating materials as described earlier.

The invention comprises, but is not limited to, the following features:

1. A switch contact structure comprised of two sliding surface assemblies in intimate contact, where at least one part of each sliding surface assembly is an electrical conductor and the remaining part or parts are an electrical insulator, forming a closed switch when the electrical parts on opposing surfaces are in mutual contact, which, when sliding apart to open, confine any arc created to the area between the surfaces of two opposing insulating parts in intimate contact, thus forcing this arc to assume the form of a very thin sheet or a multiplicity of very thin filaments.

2. The switch contact structure where the opposing surfaces are planar, triangular, quadrilateral, polygonal, cylindrical, spherical in shape or any figure of revolution or any combination of these shapes capable of sliding against each other while maintaining intimate contact over a significant area.

3. The switch contact structure where the insulating surfaces and the conductive surfaces are held in mutual intimate contact using one or more springs, elastic components, or by interference or precision fits or by any combination of springs, elastic components, and precision or interference fits.

While the invention has been described with reference to specific embodiments, modifications and variations of the invention may be constructed without departing from the scope of the invention, which is defined in the following claims.

We claim:

1. Apparatus for circuit interruption comprising at least one pair of sliding-surface assemblies comprising slidable insulating blocks, at least one pair of electrodes in the insulating blocks, a contact area in each electrode, and an arc formed between the insulating blocks when the contact areas of the at least one pair of electrodes move between a closed switch position and an open switch position or vice versa.

2. The apparatus of claim 1, wherein the insulating blocks comprise sliding surfaces in intimate contact with each other.

3. The apparatus of claim 2, wherein the insulating blocks comprise recesses for receiving the at least one pair of electrodes.

4. The apparatus of claim 3, wherein the sliding surfaces comprise nonconductive insulating surface areas.

5. The apparatus of claim 4, wherein the contact areas of the at least one pair of electrodes comprise conductive metallic contacts, and wherein the metallic contacts are disposed within the nonconductive insulating areas of the insulating blocks.

6. The apparatus of claim 5, wherein the metallic contacts are mutually aligned and contacting each other in the closed switch position, and wherein the metallic contacts are movable out of alignment and not contacting each other in the open switch position.

7. The apparatus of claim 6, wherein the arc is formed when the metallic contacts just begin to break connection.

8. The apparatus of claim 7, wherein the arc is shaped as a thin sheet between the insulating blocks held in intimate contact.

9. The apparatus of claim 2, wherein the arc is shaped as a thin sheet between the insulating blocks held in intimate contact.

10. The apparatus of claim 1, wherein the insulating block comprises conductive areas and nonconductive areas on sliding surfaces and wherein the conductive areas and nonconductive areas are in intimate contact.

11. The apparatus of claim 10, wherein the conductive areas and the nonconductive areas in intimate contact fit together tightly forming the arc as a thin sheet thereby minimizing a thickness of the arc and maximizing heat losses from the arc.

12. The apparatus of claim 11, wherein the contact areas of the electrodes comprise metallic contacts, wherein the metallic contacts are also in intimate contact with each other in the switch closed position for minimizing contact resistance between the electrodes and for enabling the contacts to conduct and interrupt high currents.

13. The apparatus of claim 11, wherein the insulating blocks are coupled by connections to ensure intimate contact between the conductive areas and the nonconductive areas.

14. The apparatus of claim 13, wherein the connections are selected from a group consisting of springs, elastic components, interference fits, precision fits, and combination thereof.

15. The apparatus of claim 2, wherein the insulating blocks comprise insulating portions on the sliding surfaces, wherein the insulating portions partially surround the contact areas.

16. The apparatus of claim 15, wherein the insulating portions are disposed only in areas near points where electrical connection is broken.

17. The apparatus of claim 2, wherein the insulating blocks have surface contours such that opposing surfaces slide against each other while remaining in intimate contact over substantial areas of the sliding surfaces.

18. The apparatus of claim 17, wherein the surface contours are selected from a group consisting of planar, triangular, quadrilateral, polygonal, cylindrical, spherical, revolutionary surfaces, and combinations thereof.

19. The apparatus of claim 2, further comprising a nonconductive insulating armature disposed between the insulating blocks for allowing the blocks to remain stationary.

20. The apparatus of claim 19, wherein the armature is slidably disposed such that a sliding of the armature relative to the insulating blocks allows for the contact areas to open and close.

21. The apparatus of claim 20, further comprising a conductive section extending through the armature.

22. The apparatus of claim 21, wherein the contact areas are in a closed switch position when the conductive section extending through the armature is in contact with the electrodes, and wherein the contact areas are in the open switch position when the conductive section is not in contact with the electrodes.

* * * * *